US006471537B2

(12) United States Patent
Huang

(10) Patent No.: US 6,471,537 B2
(45) Date of Patent: Oct. 29, 2002

(54) FLAT CABLE CONNECTOR WITH LEAD FIXING DETENTS

(75) Inventor: Chien-Pin Huang, Taipei (TW)

(73) Assignee: Guann Tau International Corporation, Taipei (TW)

( * ) Notice: Subject to any disclaimer, the term of this patent is extended or adjusted under 35 U.S.C. 154(b) by 0 days.

(21) Appl. No.: 09/797,836

(22) Filed: Mar. 5, 2001

(65) Prior Publication Data

US 2002/0039856 A1 Apr. 4, 2002

(30) Foreign Application Priority Data

Oct. 3, 2000 (TW) ..... 89211727A01

(51) Int. Cl.[7] ..... H01R 13/58
(52) U.S. Cl. ..... 439/418; 439/457; 439/459
(58) Field of Search ..... 439/456, 459, 439/496, 495, 942, 418, 457

(56) References Cited

U.S. PATENT DOCUMENTS 5,662,493 A * 9/1997 Reichle ..... 439/942
5,830,005 A * 11/1998 Watanabe ..... 439/418
5,899,770 A * 5/1999 Ezawa ..... 439/942
5,997,337 A * 12/1999 Torii ..... 439/942

* cited by examiner

*Primary Examiner*—Gary F. Paumen
(74) *Attorney, Agent, or Firm*—Bacon & Thomas

(57) ABSTRACT

The present invention relates to a flat cable connector with lead-fixing detents. The connector includes a main body and a connecting seat. The connecting seat has a plurality of lead grooves at one end thereof, and a detent formed in each of the grooves. In assembly, leads of the flat cable are engaged in the lead grooves, and the detents are used to press against the leads so that the leads are fixed in place and cannot be unintentionally removed from the lead grooves. Thereafter, the connecting seat is secured to the main body such that the leads and the terminals on the main body are firmly joined. Accordingly, the assembly of the flat cable connector is more rapid and convenient, and the quality is more ensured.

1 Claim, 5 Drawing Sheets

FLAT CABLE CONNECTOR WITH LEAD FIXING DETENTS

BACKGROUND OF THE INVENTION

1. Field of the Invention

The present invention relates to a flat cable connector with additional lead-fixing detents, and more particularly, to a flat cable connector having a plurality of lead grooves each including a wire-retaining detent. In assembly, leads of the flat cable are pushed into the lead grooves past the detents such that the detents press against the leads and fix the leads in place to prevent their removal from the lead grooves. Thereafter, the connecting seat is secured to the main body such that the leads and the terminals on the main body are firmly joined. Accordingly, the assembly of the flat cable connector is more rapid and convenient, and the quality is more ensured.

2. Description of the Prior Art

In a conventional flat cable connector, as shown in FIG. 1, the leads of a flat cable 300 are respectively axially inserted into passages 2001 of a connector 200, whereupon the connector 200 is secured to a main body 100 such that terminals on the main body 100 are in contact with the leads, thereby creating a closed circuit.

However, the aforementioned flat cable connector has the following drawbacks:

1. Insertion of the leads into the passages 2001 of the connector 200 is difficult time-consuming, and labor intensive.
2. Because the leads are axially inserted into the passages, termination of thinner and softer flat cable leads is e specially difficult. Accordingly, the processing work is increased.

In order to eliminate the aforementioned drawbacks, a flat cable connector of Taiwan Utility No. 89211727 has been disclosed by the inventor of the present invention, as illustrated in FIG. 2. However, this flat cable connector doesn't have a special member to fix the leads in the lead grooves so that the leads may unintentionally be removed from the lead grooves during the processing work, which is especially a problem for thinner leads.

SUMMARY OF THE INVENTION

It is a primary object of the present invention to eliminate the aforementioned drawbacks and to provide a flat cable connector which at least includes a main body and a connecting seat. The connecting seat has a plurality of lead grooves at one end thereof, and a detent in each of the grooves. In assembly, leads of the flat cable are engaged in the lead grooves, and the detents are used to press against the leads so that the leads are fixed in place and will not be removed from the lead grooves. Thereafter, the connecting sea is secured to the main body such that the leads and the terminals on the main body are firmly joined. Accordingly, the assembly of the flat cable connector is more rapid and convenient, and the quality is more ensured.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
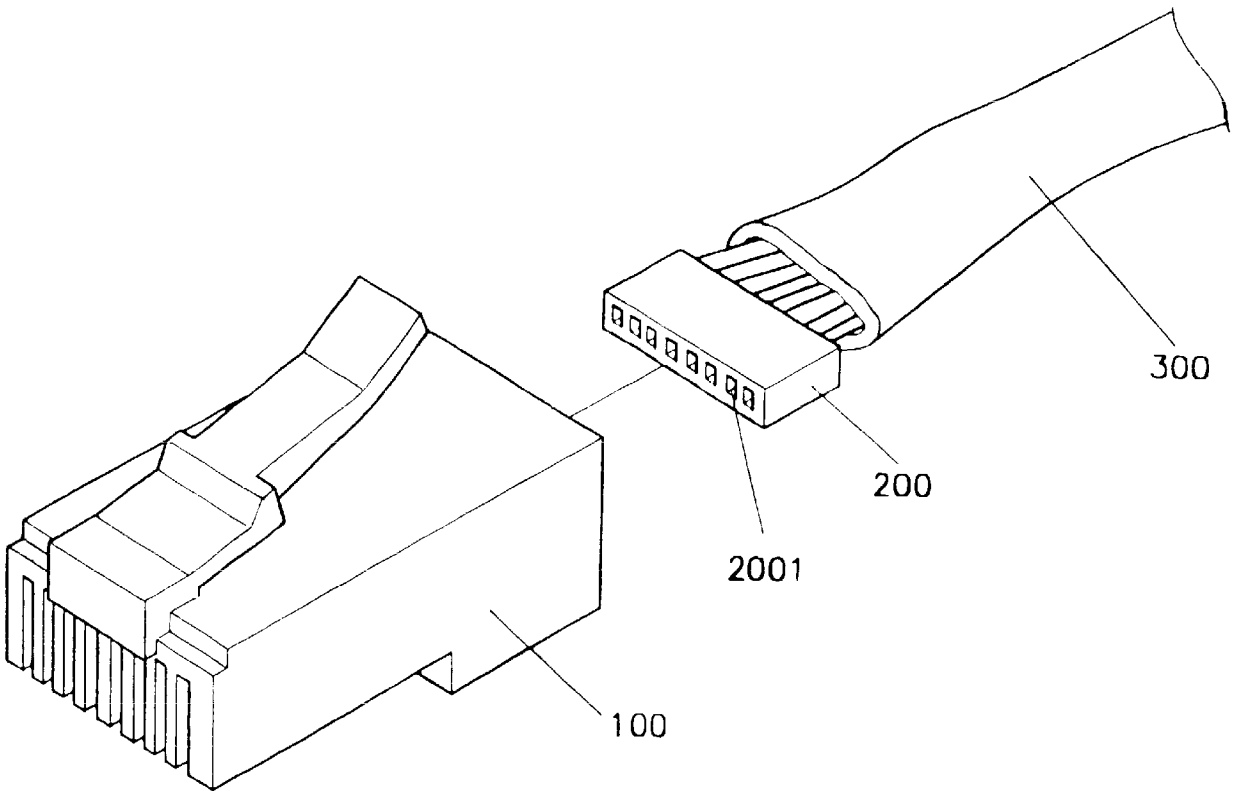
Fig. 1 PRIOR ART
FIG. 1 is a perspective view of a conventional flat cable connector of Taiwan Utility No. 89211727.
Figure 2:
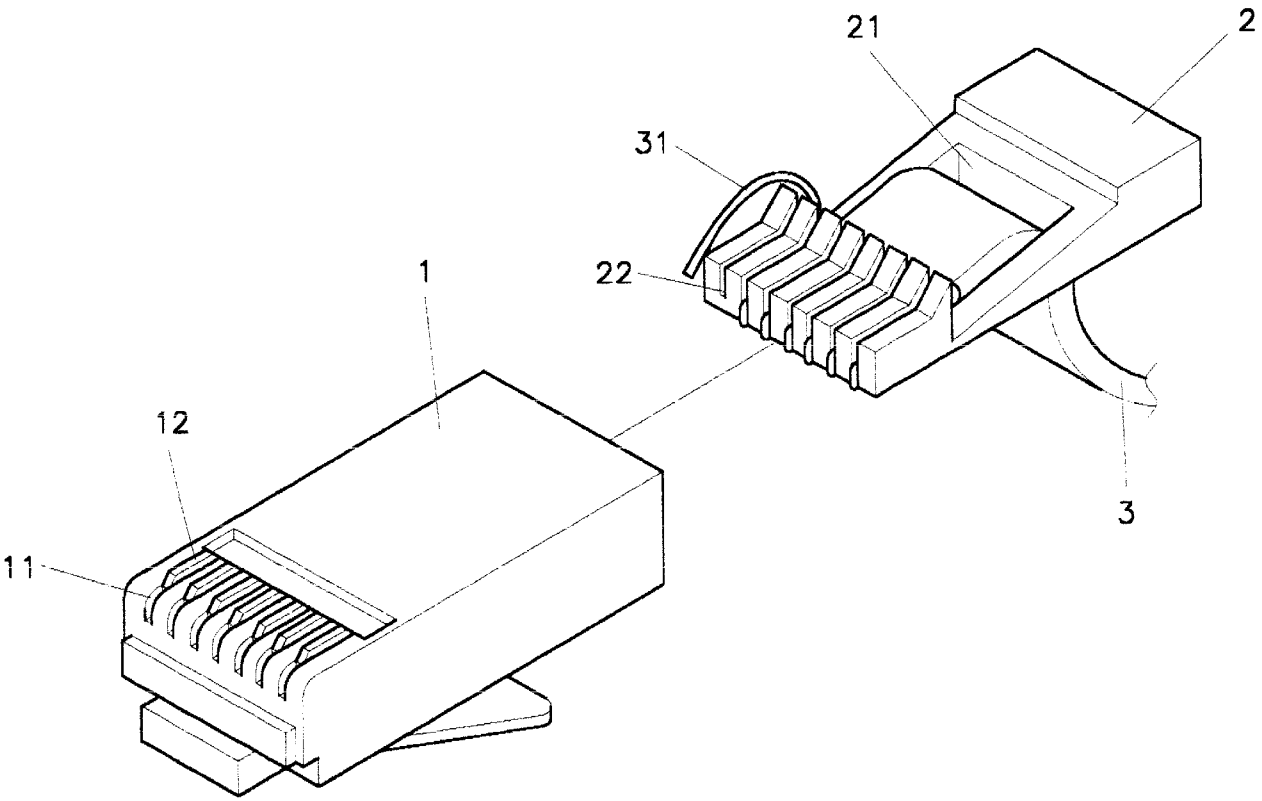
FIG. 2 is a perspective view of another conventional flat cable connector.
Figure 3:
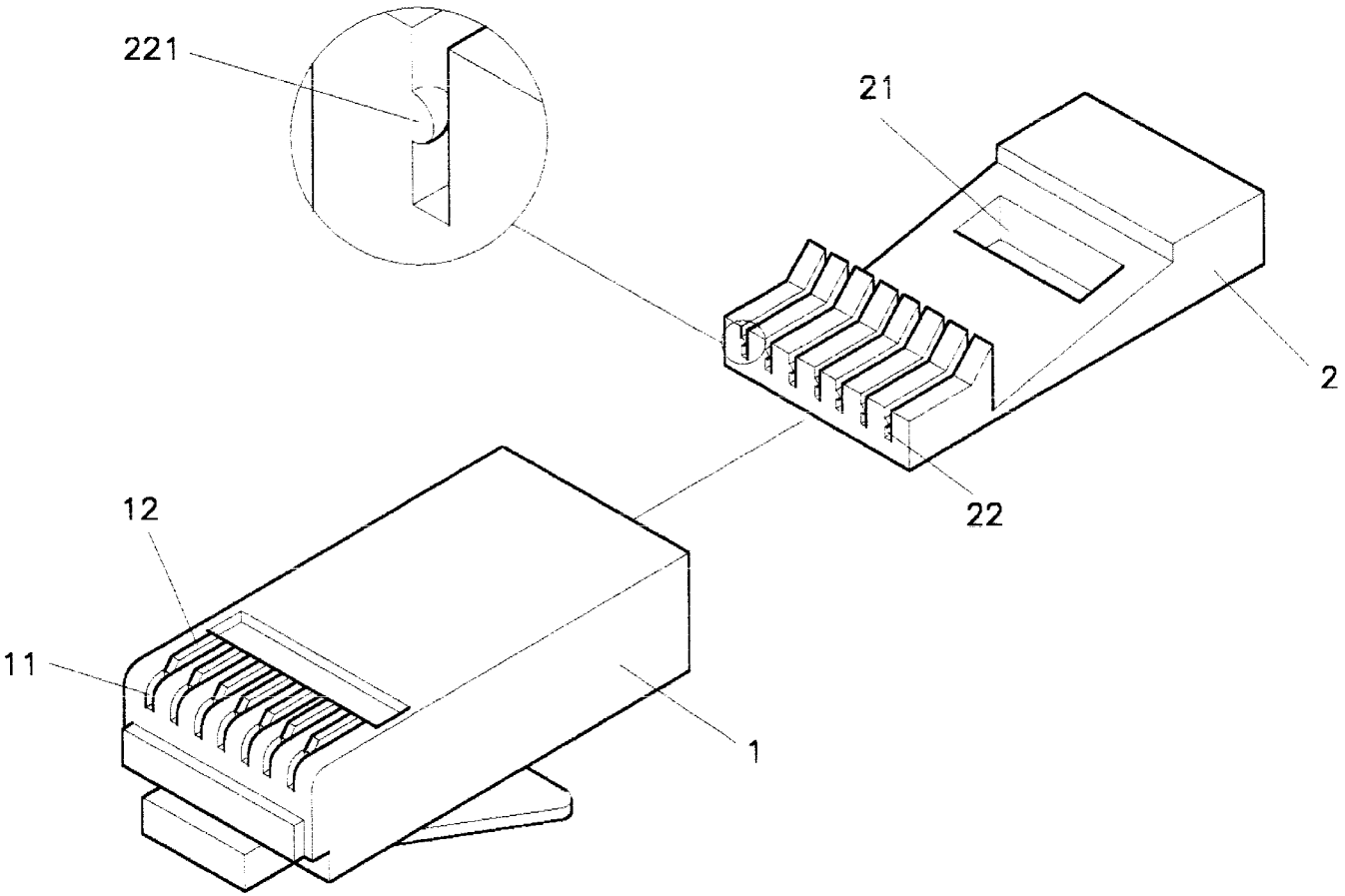
FIG. 3 is a perspective exploded view of a preferred embodiment of the present invention.

Referring to FIG. 3, the flat cable connector in accordance with the present invention at least includes a main body 1 and a connecting seat 2. The main body 1 constructed as a hollow body has a plurality of grooves 11 at one end of the top side thereof in each of which a terminal 12 is disposed. The connecting seat 2 includes a through hole 21 at a proper position thereof and a plurality of lead grooves 22 at one end thereof. The position of the lead grooves 22 corresponds to that of the terminals 12. A detent 221 is formed in Each of the lead grooves 22.

Figure 4:
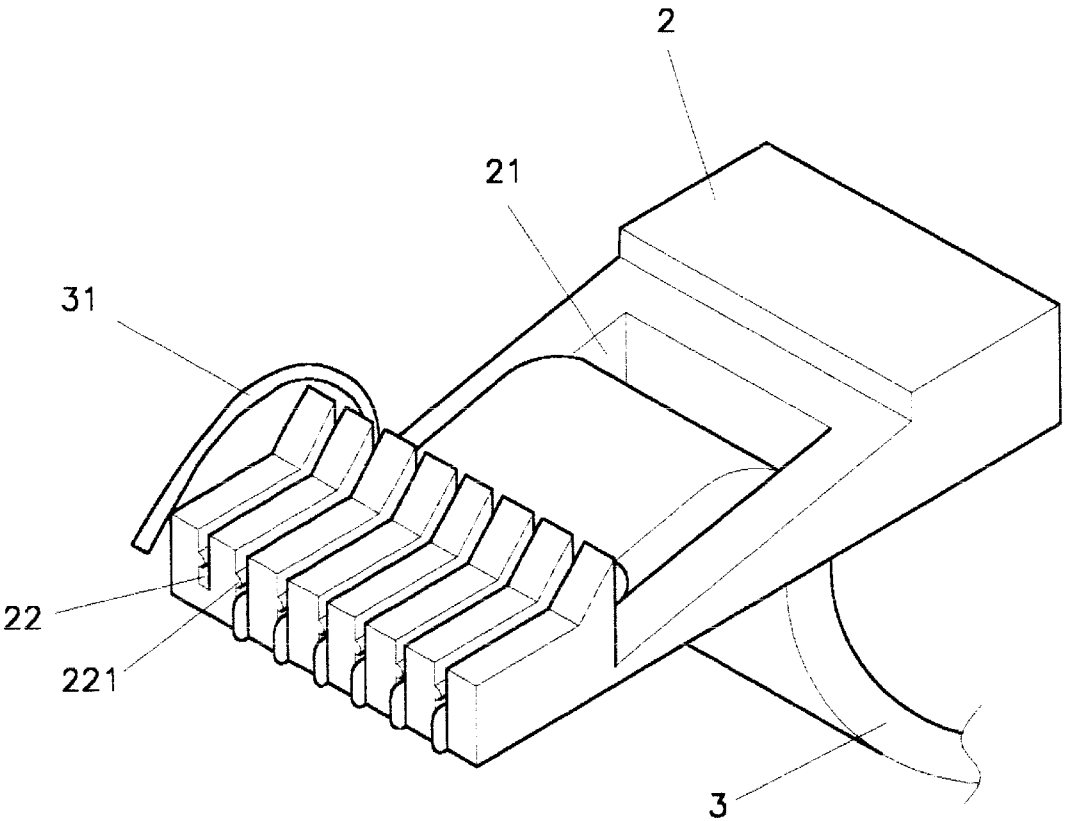
FIG. 4 is a perspective view of the assembly of a connecting seat and a flat cable of the preferred embodiment of the the present invention.
Figure 5:
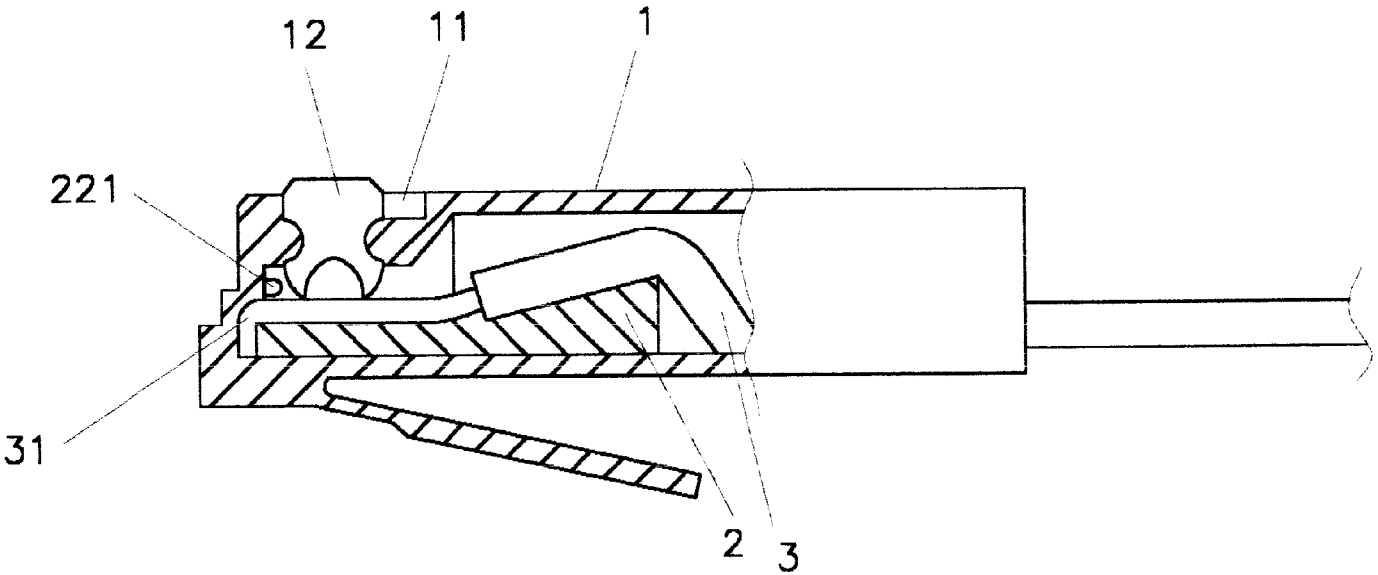
FIG. 5 is a sectional view of the preferred embodiment of the present invention.

With reference to FIG. 4 together with FIG. 5, a flat cable 3 passes from the bottom of the connecting seat 2 through the through hole 21 while leads 31 of the flat cable 3 are respectively engage d into the corresponding lead grooves 22. Thereafter, the leads 31 are bent at the end of the connecting seat 2. Then, the connecting seat 2 is inserted in the main body 1 in such a way that the leads 31 are in contact with the terminals 12 so that a closed circuit is created. The detents 221 are used to press against the leads 31 so that the leads 31 are fixed in place and cannot be unintentionally removed from the lead grooves 22 during the assembly, and the quality can be secured.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A flat cable connector with additional lead-fixing detents at least comprising:

a main body having a plurality of grooves near an end of one side thereof;

a terminal provided in each of said grooves;

a connecting seat having a through hole at one end thereof and a plurality of lead grooves at a second end thereof, wherein said through hole is arranged to receive a flat cable from which wires extend, the flat cable extending through the through hole to a position at which said wires may be received in the lead grooves of the connecting seat, wherein when said connecting seat is inserted into said main body, said wires are terminated to said terminals, and wherein said lead grooves include detents which form means for pressing against and securing said wires in said lead grooves of the connecting seat while said connecting seat is being inserted into said main body and said wires are being terminated to said terminals.

* * * * *